US005209217A

United States Patent [19]

Beach et al.

[11] Patent Number: 5,209,217

[45] Date of Patent: May 11, 1993

[54] DOWNDRAFT GAS RANGE WITH DUAL MODE BURNER SYSTEM

[75] Inventors: Stanley H. Beach, Indianapolis; Paul D. Noel, Greenfield; Wallace E. Schmidt, Carmel, all of Ind., Edward H. Strain, Tucson, AZ.

[73] Assignee: Maytag Corporation, Newton, Iowa

[21] Appl. No.: 919,728

[22] Filed: Jul. 24, 1992

[51] Int. Cl.[5] ..... F24C 3/00

[52] U.S. Cl. ..... 126/39 R; 126/39 K; 126/21 R; 126/299 R; 126/300; 431/354

[58] Field of Search ..... 126/21 R, 39 R, 39 J, 126/39 N, 39 H, 299 R, 299 D, 300, 39 K, 39 E; 431/286, 12, 266, 174, 354, 343; 55/DIG. 36

[56] References Cited

U.S. PATENT DOCUMENTS

| | | | |
|---|---|---|---|
| 2,870,829 | 1/1959 | Willaims | 158/113 |
| 3,162,237 | 12/1964 | Brown et al. | 158/99 |
| 3,169,871 | 2/1965 | Macchi et al. | 99/1 |
| 3,371,699 | 3/1968 | Riot | 158/119 |
| 3,468,298 | 9/1969 | Teague, Jr. et al. | 126/39 J |
| 3,494,350 | 2/1970 | Perl | 126/39 |
| 3,592,180 | 7/1971 | Kweller et al. | 126/39 |
| 3,870,457 | 3/1975 | Perl | 431/66 |
| 3,968,785 | 7/1976 | Perl | 126/39 J |
| 4,020,821 | 5/1977 | Reid, Jr. | 126/39 E |
| 4,409,954 | 10/1983 | Berlik et al. | 126/39 M |
| 4,413,610 | 11/1983 | Berlik | 126/39 K |
| 4,413,611 | 11/1983 | Berlik | 126/39 E |
| 4,457,293 | 7/1984 | Berlik | 126/39 M |
| 4,518,346 | 5/1985 | Pistien | 431/266 |
| 4,565,523 | 1/1986 | Berkelder | 431/354 |
| 4,569,328 | 2/1986 | Shukla et al. | 126/39 R |
| 4,570,610 | 2/1986 | Himmel | 126/39 |
| 4,622,946 | 11/1986 | Hurley et al. | 126/39 |
| 4,690,636 | 9/1987 | LeMonnier de Gouville et al. | 431/354 |
| 4,705,019 | 11/1987 | Beach et al. | 126/299 D |
| 4,736,729 | 4/1988 | Beach | 126/39 R |
| 4,750,470 | 6/1988 | Beach et al. | 126/39 R |
| 4,757,801 | 7/1988 | LeMonnier et al. | 126/39 H |
| 4,773,383 | 9/1988 | LeMonnier de Gouville et al. | 26/39 R |
| 4,794,907 | 1/1989 | Corliss et al. | 126/39 R |
| 4,960,377 | 10/1990 | Nunes et al. | 431/354 |
| 4,971,024 | 11/1990 | Albon et al. | 126/39 B |
| 5,046,477 | 9/1991 | Bennett et al. | 126/39 B |

FOREIGN PATENT DOCUMENTS

| | | |
|---|---|---|
| 1443553 | 7/1976 | United Kingdom . |
| 1543618 | 4/1979 | United Kingdom . |

*Primary Examiner*—James C. Yeung
*Attorney, Agent, or Firm*—Willian Brinks Olds Hofer Gilson & Lione

[57] ABSTRACT

A dual mode downdraft gas range provides a number of substantial advantages, including operation in a powered burner mode and an atmospheric mode. In the powered burner mode, a plurality of powered open flame surface burners can provide even heat from each of the burners as a result of burner flames that provide substantially complete combustion close to the burner outlets in short, stable flames that are unaffected by an adjacent downdraft exhaust or other outside influences. In the atmospheric mode, the gas burners can operate without a downdraft exhaust. The gas range can meet agency requirements in both the powered mode and atmospheric mode of operation and can be inherently fail-safe in the event of a power failure in the downdraft exhaust system. The gas range can be economically and easily manufactured and assembled, with burner controls arranged for convenient operation at one side of the range box for the plurality of burners.

17 Claims, 2 Drawing Sheets

DOWNDRAFT GAS RANGE WITH DUAL MODE BURNER SYSTEM

FIELD OF THE INVENTION

This invention relates to gas ranges including a downdraft exhaust for the cooking surface and, more particularly, relates to a sealed gas burner system for downdraft ranges to provide a variable, forced air-gas mixture for cooking, and still more particularly, relates to such gas ranges which are also adapted for operation as atmospheric ranges.

BACKGROUND OF THE INVENTION

Gas ranges typically use atmospheric burners. Such atmospheric burners perform well when a plentiful supply of secondary air surrounds the burner. Typically, secondary air is supplied in such ranges through one or more aeration openings in the burner pan surrounding the burner body. In addition, secondary air is often supplied through a central opening in the burner. Such openings, however, create problems in the use of gas ranges because they permit spills, boilovers and the like to run from the top of the gas range into its interior, creating an undesirable cleaning problem.

Furthermore, combustion of any fuel, including natural gas and the other gas fuels that are used in household gas ranges, generally results in undesirable byproducts such as carbon monoxide (CO) and oxides of nitrogen ($NO_x$). These pollutants are not direct products of perfect combustion but generally result from incomplete combustion and the presence of secondary air. Efforts to protect the environment have resulted in legislation and standards to limit permissible levels of such pollutants in both the United States and Europe, and it is expected that such legislation will become more widespread and that the resulting standards will become more stringent. It is clearly desirable to avoid the generation and distribution of such pollutants during the operation of gas ranges in the household of a user, and various apparatus have been proposed to reduce the generation and distribution of pollutants in the operation of gas burners.

As indicated above, it is desirable that the range top be sealed to preclude liquids and materials from entering the interior of the range. Some sealed, smooth-top gas ranges have included blowers or fans to produce both a flow of combustion air to, and an exhaust of combustion products from, burners that are located under a sealed glass or ceramic top of the range. See U.S. Pat. Nos. 2,870,829; 3,404,350; 3,870,457; 3,968,785; and 4,020,821. For example, U.S. Pat. No. 4,020,821 to Reid, Jr. et al, discloses a gas burning range with a sealed, smooth, glass or ceramic top lying over a plurality of infrared burners. In the gas range of Reid, Jr. et al., a primary gas/air mixture is provided for each burner from a combined gas and air shutter valve to a burner tip for combustion. A blower creates a negative pressure in each burner and throughout the flow path for the fuel gas, draws a flow of additional air for combustion into the gas flow path, and creates an exhaust for the combustion products leaving the burners. Such sealed top ranges generally rely on infrared heating of cooking utensils through the sealed top and are thus not as thermally efficient or as fast as open flame ranges.

Sealed top gas ranges with open flame burners have been obtained by, for example, sealing the burner head to the top range surface or burner pan. The use of such "sealed burners" in gas range construction eliminates the openings through which secondary air reaches the burners, and the air needed for combustion must enter the combustion zone in a path which is below the existing products of combustion, and the performance of the range burners is vulnerable to a number of adverse effects. Among the problems presented by such open flame, sealed burner constructions are the recirculation of products of combustion, the tendency of the gas flames to "reach" for combustion air which distorts the flame pattern and detracts from even heat distribution, the destruction of flame patterns as a result of adjacent walls that interfere or divert the secondary air supply, and flame distortion created by the simultaneous operation of adjacent burners that compete for secondary air as their flames tend to be drawn toward the natural thermal updraft of the adjacent burners. Attempts to solve such problems have included high grate tops and other barriers seeking to prevent such burner interaction.

Gas ranges with downdraft exhaust systems are known, as shown, for example, by U.S. Pat. Nos. 4,413,610; 4,413,611; 4,409,954; 4,457,293; and 4,750,450.

The problems attendant sealed burners are compounded in gas ranges with downdraft exhausts. The purpose of the downdraft exhaust is, of course, to remove products of combustion and cooking vapors from the gas range during its operation by creating a flow of exhaust air across the top of the range adjacent the burners. The air flow from such a forced exhaust pulls the flames in the direction of the exhaust, interfering with proper combustion and heat distribution at the burners. The air flow created by the downdraft exhaust means also pulls the secondary air away from the burner flames, and the disturbed flame cones impinge on relatively cold grate fingers to cause incomplete combustion. In some designs, heat from the burners of a downdraft gas range has been so unevenly distributed that it is not possible to evenly cook such foodstuffs as pancakes, eggs and sausages in a large skillet. In addition, a low simmer flame cannot be satisfactorily stabilized and ignition of the flame becomes unreliable.

Prior efforts to combine open flame sealed burners with a downdraft exhaust have also used shields extending several inches above the burner to help protect the burner flame from the exhaust flow. Other attempts have elevated the entrance to the downdraft exhaust plenum several inches above the cooktop in an effort to minimize the adverse effect of the exhaust at the cooktop surface. In still further efforts, the downdraft exhaust has been reduced in power, or the entrance to the downdraft plenum has been remotely located from the burners, or has been reduced in intake area, in attempts to minimize the adverse effect of the exhaust. Each of these methods, however, detracts from the effectiveness of the downdraft exhaust and reduces its ability to capture and remove cooking vapors, odors, heat and other products of combustion and cooking.

The use of powered gas burners in gas cooking ranges has been disclosed in the art. For example, U.S. Pat. No. 3,468,298 to Teague, Jr. et al. discloses a sealed, smooth-top gas range with a plurality of powered infrared burners. In the gas range of Teague, Jr. et al, a blower supplies air to and pressurizes a manifold extending along the front of the range. The manifold has openings formed in its bottom, one for each of the plurality of burners. A slide valve for each burner includes air control orifices cooperating with a manifold opening for each burner to permit a variable and controllable flow of combustion air from the manifold into a separate valve manifold, and from the separate valve manifold through a venturi mixer to its associated burner. Gas flow to the venturi mixer and burner is controlled by a diaphragm-operated gas flow regulator, which is operated by the air pressure in the valve manifold to control the gas/air mixture to each burner.

U.S. Pat. No. 4,569,328 to Shukla et al. seeks to avoid emission of air pollutants, such as carbon monoxide and oxides of nitrogen, into the kitchen. The Shukla et al. patent discloses a gas range with a ceramic tile forming a plurality of openings provided, preferably, with a forced air-gas mixture and adapted to provide an open standing flame close to its upper surface so that the ceramic tile burner will provide high radiant heat as a result of the gas flame. In Shukla et al.'s invention, a jet plate is positioned between the infrared burner and the supporting surface for the cooking utensil. The jet plate is stated to be of considerable importance in the achievement of high thermal efficiencies. Shukla et al.'s jet plate includes a plurality of perforations or jet holes to form high velocity gas jets from the combustion products of the infrared burner, and the gas jets are directed to impinge against and convectively heat the lower surface of the cooking utensil and then pass into the atmosphere of the kitchen above the cooktop.

While Shukla et al. discloses that his ceramic tile may operate as an atmospheric burner, in Shukla et al.'s preferred embodiment, a blower is positioned in the central portion of the range to pressurize an air plenum, which is linked to a plurality of mixing valve assemblies to control the flow of the forced air-gas mixture to the plurality of burners. Each mixing valve assembly provides a selected stoichoimetry for its associated burner by mechanically coupling a rotatable air orifice plate to a gas valve shaft so that by rotation of the gas valve shaft to control gas flow, air flow is simultaneously controlled by the alignment of one or more of several discrete openings in the air orifice plate with a fixed opening in an air flow tube.

U.S. Pat. No. 4,960,377 to Nunes et al. discloses a gas-air mixing valve for use with residential and commercial cooking ranges. The Nunes et al. valve is designed for use preferably in a gas range having a plurality of gas burners. The Nunes et al. valve is attached to an air plenum which is pressurized by an air blower. The Nunes et al. valve is adapted to be mounted over a hole formed in the air plenum and to provide two valve openings communicating with the interior of the air plenum, one of the valve openings forming an inlet to an air-gas mixing chamber within the valve, and the other valve opening communicating with atmosphere. The two valve openings to the pressurized air plenum formed by the Nunes et al. valve are covered by a rotating orifice plate. The rotating orifice plate includes an opening cooperating with the opening between the air plenum and the air-gas mixing chamber, and an opening cooperating with the opening to atmosphere so that as the size of the entrance to the air-gas mixing chamber is increased by rotation of the orifice plate, the size of the opening between the air plenum and atmosphere is correspondingly decreased to maintain a constant air flow in the plenum for the operation of each of the gas burners. As the orifice plate is rotated, the gas valve is also operated to maintain a selected forced air-gas mixture to each cooking burner.

Other arrangements of gas ranges with power burners, and air/gas control valves for gas ranges with power burners are disclosed in U.S. Pat. Nos. 3,162,237; 3,169,871; 3,371,699; 3,592,180; 4,622,946; and 4,794,907. Notwithstanding these various developments, the use of powered surface burners is rare in household gas ranges. Variations in the characteristics and burning properties of gas from utility to utility and locale to locale have made it difficult to achieve reliable and repeatable combustion characteristics with powered surface burners in a household range.

Other patents disclosing sealed burners include British Pat. Nos. 1,443,553; and 1,543,618; and U.S. Pat. Nos. 4,518,346; 4,565,523; 4,570,610; 4,690,636; 4,757,801; 4,773,383; 4,971,024; and 5,046,477.

Notwithstanding the efforts of others, no one, prior to this invention has provided a dual mode gas range with the combined advantages and abilities of a sealed top construction, downdraft exhaust and open flame gas burners that are operable with a powered gas/air mixture with a downdraft exhaust, and otherwise as an atmospheric range.

SUMMARY OF THE INVENTION

The invention provides a thermally efficient sealed gas range with a downdraft exhaust combined with an open flame gas burner that limits the generation of CO and $NO_x$, is substantially immune to the adverse effects of the downdraft exhaust and of adjacent walls, and provides even heat distribution with and without the downdraft exhaust. Gas ranges of the invention feature good combustion, ignition and re-ignition with low levels of generated CO and $NO_x$, a high turndown ratio with a stable low flame setting, a high thermal efficiency at least equal to existing atmospheric gas ranges, a large entrance to the downdraft exhaust substantially flush with the cooktop and located effectively adjacent the burners, freedom from surface barriers or shields which inhibit the effectiveness of the downdraft exhaust, and immunity from adjacent walls, providing greater freedom in installation of the range.

The invention provides a gas range including a top surface adapted to be sealed to a gas burner assembly, and a downdraft plenum adjacent the gas burner assembly adapted to draw cooking vapors, heat and the products of combustion and cooking from adjacent the surface of the range and the gas burner assembly, and a sealed, powered gas burner assembly comprising a gas burner and a combined air and gas supply means adapted for connection with an air flow source and a gas flow source to provide a combustible gas-air mixture to a sealed conduit connected between the gas burner and the combined air and gas flow supply means. The combined air and gas flow supply means combines flows of primary combustion air and gas from their respective sources and controls the air flow and gas flow to provide a burning gas/air jet at each burner outlet with rapid, substantially complete combustion in a short, stable flame which is unaffected by such outside influences as the downdraft exhaust. The means for providing a combined air flow and gas flow can comprise a mixing manifold between the sealed conduit and air and gas flow sources, with control means providing a controlled flow of air and gas from the manifold to the sealed conduit. In preferred embodiments, the control means can further comprise separate air flow and gas flow control valves between the mixing manifold and the sources of air flow and gas flow respectively.

The invention provides a method of cooking with gas and a downdraft exhaust by directing a controllable flow of combustion air through a first conduit and a controllable flow of gas through a second conduit, mixing the controllable flows of combustion air and gas to provide a directed combustible flow of air and gas through a third sealed conduit to the gas burner, controlling the flows of combustion air and gas to provide a controlled variable combustion of gas at the gas burner, combusting the directed flow of combustion air and gas from the gas burner for cooking, and exhausting gaseous combustion and cooking byproducts by providing a downdraft adjacent the gas burner. In the invention, a powered flow of primary combustion air and gas flow are provided from within each of the plurality of burner outlets to form combusting gas/air jets with rapid and substantially complete combustion close to the burner outlets, in short, stable flames which are unaffected by the downdraft exhaust and other outside influences and provide even heat distribution.

The invention further provides a gas range with dual modes of operation with sealed gas burner assemblies that can be effectively operated as both atmospheric burners and powered burners.

In preferred dual-mode embodiments, the downdraft gas range includes an air plenum connected with a combustion air blower, or fan, which has its inlet open to atmosphere and can be powered to supply the air plenum with air at a pressure slightly above atmospheric pressure. In a preferred embodiment, a plurality of separate mixing manifolds, one for each sealed burner assembly, share a common wall with the air plenum. The common wall is provided with a plurality of air flow openings, one between each mixing manifold and the air plenum, to permit primary combustion air flow from the air plenum into the mixing manifold of each sealed burner. A plurality of gas valves, one for each burner, control the flow of gas into the mixing manifolds and to each burner. The actuator shafts for each gas valve are provided with a shaped air flow control cams, which are located adjacent the air flow openings in the common wall for each mixing manifold. Each actuator shaft thus permits simultaneous control of the rates at which gas and primary combustion air are admitted to the mixing manifold for each burner and mixed for delivery to each sealed burner assembly.

A gas range of the invention provides a dual mode of operation, either with powered burner operation or with atmospheric burner operation. In preferred ranges, the downdraft exhaust blower and the combustion air blower are controlled so that the combustion air blower for powered burner operation is available whenever the downdraft exhaust blower is operated. With the downdraft exhaust on, the combustion air blower is operated to pressurize the air plenum so a powered flow of combustion air can be controlled and provided to each sealed burner as described. With the downdraft exhaust off, the gas range is operable with primary combustion air for the burners supplied from atmosphere because the mixing manifolds can draw primary combustion air through the blower and air plenum, either or both of which can be open to atmosphere.

In a preferred range, a plurality of mixing manifolds and gas valves for the burners can be conveniently located in line along a wall of the air plenum. Furthermore, the air plenum, gas/air mixing manifolds and control valves can be conveniently located along one side of a burner box that carries a plurality of sealed burners.

Other features and advantages of this invention will be apparent from the drawings and description that follow.

BEST MODE OF THE INVENTION

Figure 1:
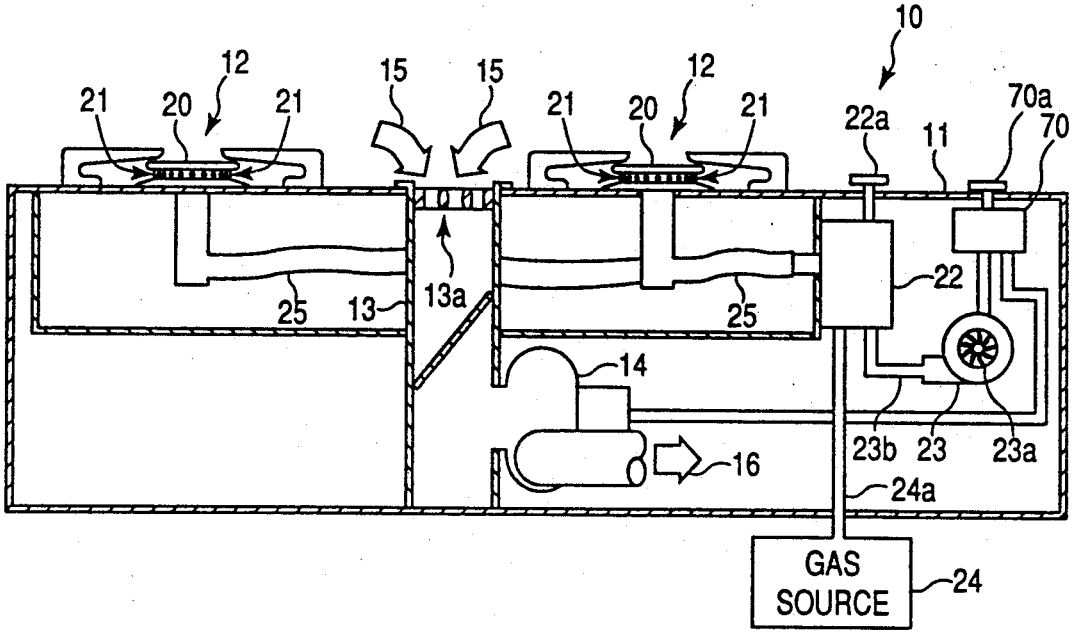
FIG. 1 is a diagrammatic partial cross-sectional drawing of a gas range of this invention to illustrate the invention.

FIG. 1 is a schematic, partial cross-sectional diagram of a downdraft gas range of the invention. As shown in FIG. 1, the gas range 10 includes a cooktop having a top surface 11 adapted to be sealed to one or more gas burner assemblies 12. The range 10 further includes a downdraft plenum 13 with an entrance **13*a* adjacent the gas burner assemblies 12. The downdraft plenum 13 is connected with an exhaust blower 14. When the exhaust blower 14 is operated, the downdraft plenum 13 withdraws air and cooking vapors from adjacent the top surface 11 and gas burner assemblies 12 of the range, as indicated by arrows 15 and 16. The sealed gas burner assemblies 12 each include a gas burner 20 having a plurality of burner outlets 21, a combined air and gas flow supply means 22 adapted for connection with an air flow source 23, and a gas flow source 24. A sealed conduit 25 is connected between each gas burner 20 and its combined air and gas flow supply means 22, and a variable supply of a combustible mixture of gas and air to each burner 20 is controlled by a knob or handle 22*a*. The combined air and gas flow supply means 22 includes means for combining the flows of air and gas and means for controlling the air flow and gas flow to provide a combined flow of air and gas through the conduit 25 and the gas burner outlets 21** for controllable combustion.

Figure 2:
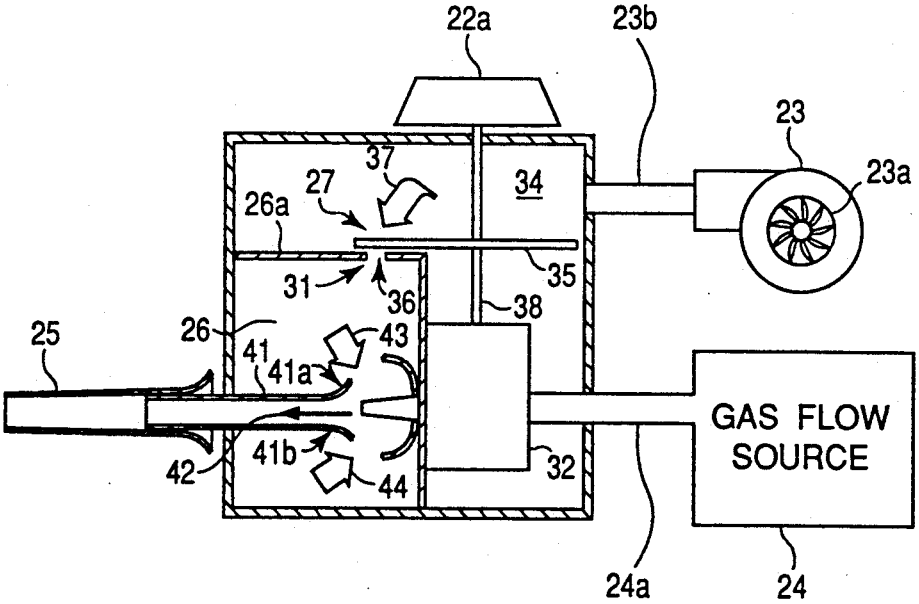
FIG. 2 is a diagrammatic partial cross-section of a combined air and gas flow supply means of FIG. 1.
Figure 3A:
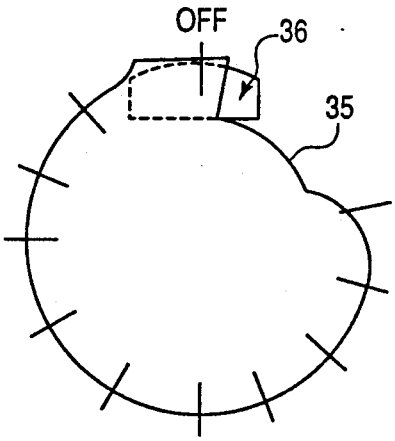
FIG. 3A is a simplified view of the air flow control plate and orifice of the combined air and gas flow supply means of FIG. 3.
Figure 3:
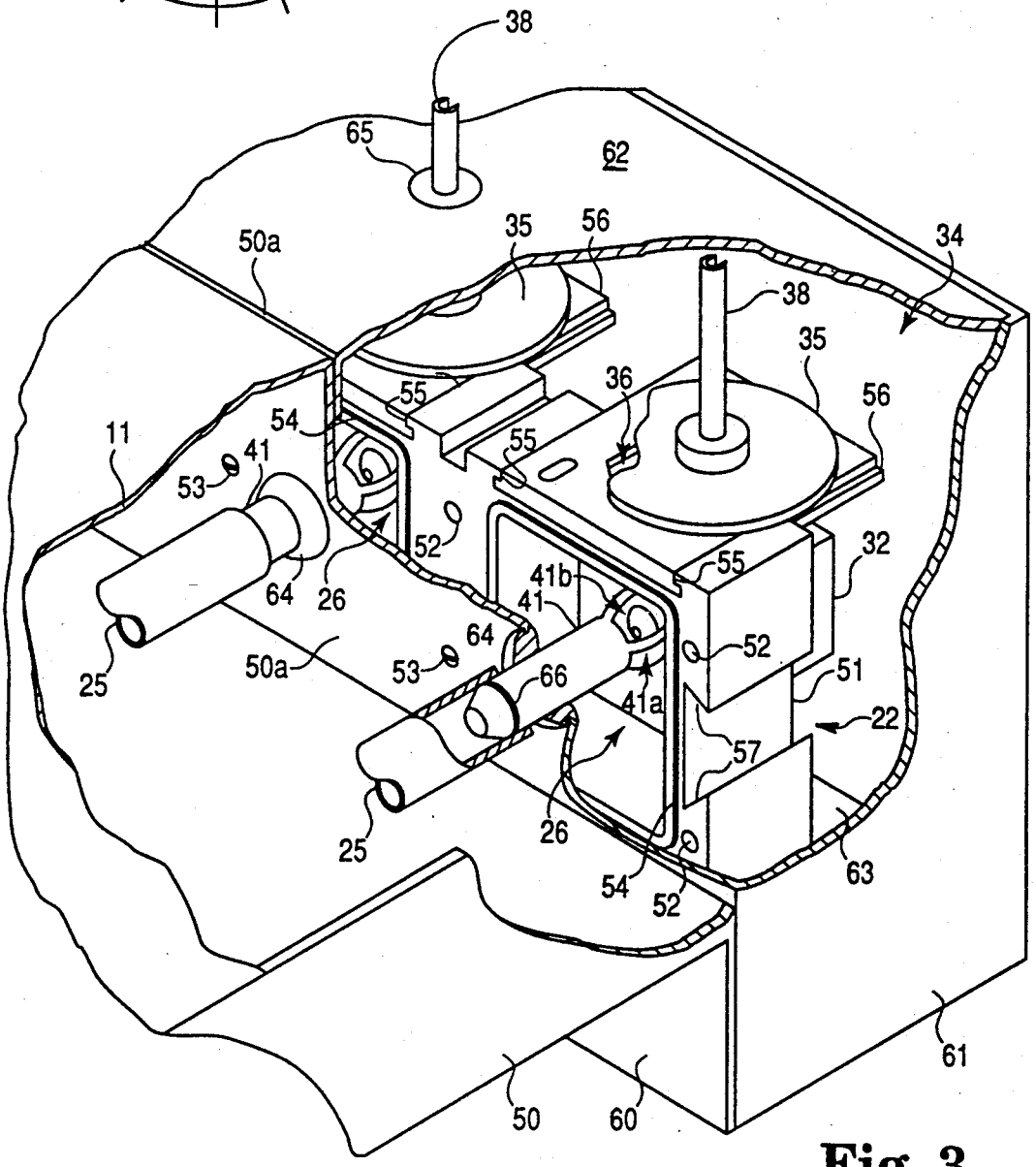
FIG. 3 is a partially broken-away prospective view of a preferred combined air and gas flow supply means of this invention.

As shown in FIG. 2, each air and gas flow supply means 22 for providing a combined air flow and gas flow includes a mixing manifold or plenum 26 between the sealed conduit 25 and the air flow and gas flow sources 23 and 24, respectively. Air flow source 23 preferably includes a small fan or blower, which supplies a flow of primary combustion air to air plenum 34, which is maintained at a pressure slightly above atmospheric pressure, for example, about 0.3 to about 0.5 inches of water column pressure above atmospheric pressure. Mixing manifold 26 and air plenum 34 share a common wall **26*a*. The air and gas flow supply means 22 also provides control means 27 for providing a controlled flow of both air and gas from the mixing manifold 26 to the sealed conduit 25. As shown in FIGS. 2 and 3, the control means 27 comprises a separate air flow control means 31 between the air plenum 34 and the mixing manifold 26 and a separate gas control valve 32 between the gas flow source 24 and the mixing manifold 26**.

In the embodiment of the combined air flow and gas flow supply means 22 that is shown in FIGS. 2 and 3, air flow from air blower 23 is directed to air plenum 34, which provides a large reservoir of pressurized air in communication with the mixing manifold or plenum 26. Air flow control means 31 is formed by a rotating air flow control plate 35 relative to an air flow opening 36 formed in the common wall 26*a* leading to the mixing manifold 26. As indicated in FIG. 2 and shown in FIGS. 3 and 3A, the air flow control plate 35 includes a shaped flow control plate, which lies adjacent to and over the air flow orifice 36. By rotating the air flow control plate 35 clockwise in FIG. 3, the air flow opening 36 becomes progressively less blocked by the air flow control plate 35 thereby controlling the air flow, indicated by arrow 37 in FIG. 2, from the air plenum 34 to the mixing manifold or plenum 26 through air flow opening 36. As shown in FIGS. 2 and 3, the air flow control plate 35 is mounted on an actuator shaft 38 which also controls the gas flow control valve 32. By rotation of the knob or handle 22*a*, a user of the range may simultaneously control the gas flow through gas flow control valve 32 from the gas flow source 24 into injector 41 and conduit 25, and the air flow from air plenum 34 through air flow opening 36 into manifold 26, injector 41 and conduit 25.

As indicated in FIG. 2, the manifold 26 includes an injector 41. Gas flow from the gas flow control valve 32, indicated by arrow 42, induces the flow of air, indicated by arrows 43 and 44, through injector openings 41*a* and 41*b* for mixing with the gas flow 42. The combined air flow and gas flow are directed by injector 41 into the sealed conduit 25 for direction to one of the gas burners 20 and through the gas burner outlets 21 (shown in FIG. 1). Air flow source 23, preferably, includes a small air blower providing a controllable flow of air to air reservoir 34.

The blower 23 which comprises the air flow source has an inlet 23*a* open to atmosphere. When the gas range is operated in the powered mode, blower 23 draws air through the inlet 23*a* for delivery to and pressurization of air plenum 34 to provide controlled flow of primary combustion air into each of the mixing manifolds 26. When the range is operated in the atmospheric mode, primary combustion air for the burners is drawn into the mixing manifolds, by the flow of gas into the injectors 41, from the air plenum 34, which is supplied through the open inlet 23*a* of the blower 23. In addition, air plenum 34 need not be sealed and combustion air can also be supplied through the unsealed air plenum 34.

FIG. 3 is a partially cut-away, perspective view of a preferred embodiment of the combined air and gas flow supply means 22 which is constructed in a manner similar to that indicated in FIG. 2, but is adapted for manufacture and for use in a household downdraft gas range. The structure shown in FIG. 3 is adapted for a gas range with a plurality of gas burners; however, the elements of the FIG. 3 embodiment that correspond to the elements illustrated in FIGS. 1 and 2 carry the same element numbers.

In the structure shown in FIG. 3, the range top surface 11 (partially broken away) which carries a plurality of gas burners 20 is fastened to a sheet metal weldment 50 which forms a burner box, as is well known in the art, and houses a plurality of sealed conduits 25 which lead to the plurality of gas burners 20 (not shown in FIG. 3) sealed to surface 11. The mixing manifold, or plenum, 26 for each of the plurality of gas burners may be formed by an injection box molding 51. For ease of assembly, the injection box 51 may be molded to form a plurality of plenum-forming cavities 26 so that when the injection box 51 is fastened to the side wall 50*a* (partially broken away) of the burner box 50, as indicated in FIG. 3, it forms a mixing manifold, or plenum, 26 for each of the gas burners. As indicated in FIG. 3, the injection box 51 may be molded to include a plurality of bores 52 to permit it to be fastened to the burner box 50 by screws 53 as indicated in FIG. 3. The injection box 51 may also be formed with channels 54, one surrounding each plenum-forming cavity 26, in the face which mates the wall 50*a* of the burner box 50. The channels 54 are adapted to carry O-ring seals so that upon assembly of the injection box 51 to the wall 50*a* of the burner box 50, the plenum-forming cavities 26 are sealed.

In addition, as shown in FIG. 3, the top of the injection box may be provided with a plurality of tongue and grooved portions 55 to permit a mating plate 56 (which corresponds to common wall 26*a* of FIG. 2 and carries the air flow opening 36) to be inserted into and carried by the injection box 51. By molding the injection box 51, it may be economically provided with a number of other features, such as formed grooves 57 and tongues (not shown) in their sides so that each injection box 51 can be molded with a pair of plenum-forming cavities 26, but can provide tongue and groove assembly with another injection box, end-to-end in a row, permitting simple assembly for gas ranges with 2, 4 and 6 gas burners. Thus, in preferred embodiments of the invention, the plurality of combined air and gas control means can be conveniently arranged in line at one side of the range burner box in numbers corresponding to the number of range burners.

As indicated in FIG. 3, the injection box 51 forming the mixing manifolds, or plenums, 26 is carried within a large air plenum 34 which is formed by a plurality of sheet metal wall portions carried by the burner box 50. For example, the larger air plenum 34 can be formed by a partial side wall 60, a piece of sheet metal 61 formed to provide side and back walls, a sheet metal top 62 and a sheet metal bottom 63. The air plenum 34 is connected with blower 23 (see FIGS. 1 and 2) and the air pressure within the plenum 34 is maintained slightly above atmospheric air pressure by the blower (for example, about 0.3 to 0.5 inches of water column pressure above atmospheric pressure). The plenum-forming injection box 51 is carried within the air plenum 34 by the burner box, and the injection box 51 carries at its back a plurality of gas control valves 32 which are also within the plenum 34. The gas flow control valves 32 are connected from within the plenum 34 to a gas flow source 24 (not shown in FIG. 3) by conduits 24*a*, as indicated in FIGS. 1 and 2. Gas flow to the gas burners 20 is varied by rotating the actuator shafts 38 for the gas flow valves 32. As indicated in FIG. 3, an air flow control plate 35 is carried on each of the actuators 38 immediately adjacent the plate 56 forming the air flow orifice 36. As shown in FIG. 3A, the air flow control plates or cams 35 have cam-like shapes of varying outer radii which are adapted to coact with the cooperatively shaped air flow openings or orifices 36 and provide variably-sized air flow openings and controlled air flows into the plenums 26 to provide a stable effective combustion of the variable gas flow to the burner, which is controlled by gas flow control valve 32 as a result of adjustment of the common actuator shaft 38.

As shown in FIG. 1, the gas range is provided with an electrical control 70. Through the operation of a knob or lever, the operator of the gas range may select one of the ranges dual modes of operation, with a downdraft exhaust and powered burners, or as an atmospheric range without a downdraft exhaust. The electrical control 70 is adapted to operate combustion air blower 23 and exhaust blower 14 together and to prevent their operation individually. In the preferred embodiment of the invention, combustion air blower 23 has less inertia, for example, by having a rotor with a smaller diameter or with less weight, and accelerates faster than downdraft blower 14 so that the downdraft exhaust will not interfere with flame formation upon ignition. Because of the slower acceleration of the larger or heavier downdraft blower, the flow of exhaust air at the burners can be low enough to have negligible effect on flame formation.

In operation, a variable gas flow is directed into the injector 41 within plenum 26 from the gas flow control valve 32. A controlled flow of air is injected into the gas flow through injector openings 41*a* and 41*b* within the plenum 26. The combined air and gas flow is directed from the injector into the sealed conduit 25 leading to the gas burners. As indicated in FIG. 3, the plenum 34 may be sealed at the openings provided for actuator shafts 38 with the plurality of grommets 65, the injector openings provided in the wall 50*a* of the burner box may be sealed against the plurality of injectors by grommets 64, and the injectors 41 may be sealed with the sealed conduits 25 by an O-ring seal 66 carried by the injectors 41. When the range is operated in the powered burner mode, combustion air blower 23 is operated to supply air to and pressurize air plenum 34 and exhaust blower 14 is operated to exhaust combustion and cooking byproducts. In the powered burner mode, a substantial portion of the combustion air needed is provided through the sealed conduits 25 to the burners 20. When the range is operated in the atmospheric mode, blower 14 is not operated and primary combustion air is supplied to the burners 20 through the inlet 23*a* of blower 23, air plenum 34 and mixing manifolds 26, and the burners draw secondary combustion air from adjacent the range top.

In the powered mode, a variable flow of gas for open flame cooking, at rates permitting a slow simmer as well as rapid heating, is combined with an accurate and controllable variable air flow at rates desirable for effective, substantially complete combustion of the gas with a substantially reduced need for secondary combustion air, and the accurately combined gas/air mixture is delivered to the burner outlets 21 through a sealed conduit 25 thereby preventing dilution and variation of the desired combustible mixtures, limiting the undesirable generation of CO and $NO_x$ and preventing operation of the downdraft exhaust from affecting the desired combustible mixture. The burner outlets or ports of the standard burners preferred for use in the invention have standard diameters of about 0.05 to about 0.015 inch and preferably have a relatively long bore length having a substantial fraction of an inch, for example, about 0.312 to about 0.343 inch. One such burner may have, for example, a first ring of 18 ports with a diameter of 0.142 inch, and 6 ports with a diameter of 0.079, all with a bore length in the above range. The burner may also have a second ring of 16 ports with a diameter of 0.051 inch and a bore length of 0.060 inch spaced below the first ring. The combination of such burner outlets with relatively high air flow rates, providing, for example, a substantial percentage of the combustion air needed, improve burner operation. Orifices or ports formed with thin walls, such as 0.030 inch, are not preferred. Furthermore, the combination of a burner provided with gas flow and a desirable high percentage rate of air flow through a sealed conduit (thereby substantially reducing the burners need for secondary air) and an effective adjacent downdraft exhaust provides a household gas range which can substantially free the household of undesirable pollutants.

In the powered mode of the invention, a powered flow of combustion air and a gas flow are provided from within the burner outlets to form combusting gas/air jets with rapid and substantially complete combustion of the gas close to the burner outlets in short stable flames which are unaffected by the downdraft exhaust and other outside influences and provide even heat distribution around the burner. The resulting flames are believed to be impervious to the downdraft exhaust and other such outside influences because of the resulting "structural integrity" of the rapidly moving gas/air jet and its rapid, substantially complete combustion. For example, with the preferred burners and burner outlets described above, clean, sharp, stable flames can be obtained, providing even heat distribution as high as 10000 BTUH with a gas pressure of about 5 inches of water column pressure above atmospheric pressure, and with an estimated primary air flow rate in excess of about 75 to about 85 cubic feet per hour and preferably in excess of 85 cubic feet per hour.

Thus, the invention permits effective cooking with a gas burner and downdraft exhaust by directing a controllable flow of combustion air through a first conduit 23*b*, directing a controllable flow of gas through a second conduit 24*a*, mixing the controllable flows of combustion air and gas to provide a directed flow of combustion air and gas through a third sealed conduit 25 to a gas burner 20, controlling the flows of air and gas to provide a controllable variable combustion of gas from the outlets 21 of gas burner 20, combusting the directed flow of air and gas at the gas burner outlets for cooking, and exhausting gaseous combustion and cooking byproducts by providing a downdraft exhaust into plenum 13 adjacent the gas burner 20.

In the method of the invention, the flows of air and gas are preferably controlled before they are mixed as shown in FIGS. 2–3. The flows of combustion air and gas are preferably passed through at least one manifold or plenum 26 and are mixed in a mixing head such as the injector 41. In the method of the invention, the downdraft exhaust can be urged into an opening 13*a* in the sealed top 11 of the gas range adjacent the gas burner 20. The directed flows of combustion air and gas are divided at the gas burner into a plurality of flows for combustion and the plurality of flows are given flow rates and velocities that provide stable gas/air jets, rapid and substantially complete combustion and cooking flames that provide even heating in the presence of the adjacent downdraft exhaust. The method further includes control of the air flow, for example, by air flow control plate 35, to provide for variable gas flows from gas flow valve 32 and an air flow rate required to burn gas flow down to low rates, for example, rates low enough to provide simmering foods stuffs.

In the atmospheric mode of operation, the flow of gas into the injectors 41 induces a flow of air from atmosphere through air plenum 34 and opening 23*a* of the combustion air blower 23. By directing a controlled flow of gas and induced flow of air from atmosphere to the burners 20 through the sealed conduits 25 and combusting the gas at the gas burner 20 while precluding operation of the downdraft exhaust, the gas range burners can be operated from atmosphere.

In one example of the invention, it was found that heat was evenly distributed to a 10 inch black cast-iron skillet, permitting pancakes to be cooked quickly with even doneness on all portions of the skillet in the presence of a downdraft exhaust through an exhaust opening adjacent the gas burner at a downdraft flow rate of approximately 300 cubic feet per minute throughout the system and a velocity of 1,400 feet per minute at the exhaust opening. The invention permitted the obtaining of clean, sharp, stable flames with approximately 10,000 BTUH output at not more than 5 inches of water column pressure above atmospheric pressure.

Thus, the invention provides a downdraft gas range with a number of substantial advantages including dual mode operation. The gas ranges of the invention can include a plurality of powered open flame surface burners providing even heat from each of the burners as a result of burner flames that provide substantially complete combustion close to the burner outlets in short, stable flames that are unaffected by an adjacent downdraft exhaust or other outside influences. The gas range of the invention can also operate in an atmospheric mode without a downdraft exhaust and meet agency requirements in both the powered mode and atmospheric mode of operation and can be inherently fail-safe in the event of a failure in the downdraft exhaust system. Furthermore, the invention permits a gas range with economically and easily manufactured and assembled burner controls arranged for convenient operation at one side of the range burner box for a plurality of burners.

While the description and drawings set forth the currently known best mode of the invention, other embodiments of the invention may be made without departing from the scope of the claims that follow. Accordingly, the invention is to be limited only by the scope of the claims and the prior art.

We claim:

1. A dual mode downdraft gas range adapted to provide a gas burner with atmospheric and powered combustion air, comprising:

a cooktop comprising a top surface adapted to be sealed to a gas burner assembly;

a downdraft plenum adjacent the gas burner assembly adapted to withdraw combustion byproducts and cooking vapors from adjacent the top surface and gas burner assembly;

a sealed gas burner assembly comprising a gas burner having a plurality of burner outlets, combined air and gas flow supply means adapted for connection with an air flow source and a gas flow source, said air flow source comprising means for providing air flow at pressures above atmospheric pressure in the presence of a downdraft exhaust and from atmosphere in the absence of a downdraft exhaust; and a sealed conduit connected between said gas burner and said combined air and gas flow supply means, said combined air and gas supply means including means for combining air flow and gas flow from said air flow source and gas flow source and control means for controlling the air flow at pressures above atmospheric pressure and the gas flow to provide a combined flow of air and gas through said sealed conduit and said gas burner outlets for controllable combustion.

2. The dual mode downdraft gas range of claim 1 wherein said air flow source further comprises a combustion air blower adapted for providing air flow at pressures above atmosphere when operated from an inlet open to atmosphere, and said range further comprises a downdraft exhaust blower and an electrical control for said combustion air blower and said downdraft exhaust blower, said electrical control being adapted to operate said combustion air and downdraft exhaust blowers only simultaneously.

3. The dual mode downdraft gas range of claim 2 wherein said air flow source comprises an air plenum connected to said combustion air blower and supplying said combined air and gas flow supply means with combustion air.

4. The dual mode downdraft gas range of claim 3 wherein said combined air flow and gas flow supply means comprises a gas/air mixing manifold in communication with said air plenum, and said control means comprises a separate air flow control valve between said air plenum and said gas/air mixing manifold.

5. The dual mode downdraft gas range of claim 4 wherein said air plenum and gas/air mixing manifold share a common wall.

6. The dual mode downdraft gas range of claim 5 wherein the common wall includes an air flow opening and said air flow control valve comprises an adjustable air flow control plate adjacent said air flow opening.

7. The dual mode downdraft gas range of claim 6 comprising a plurality of combined air flow and gas flow supply means having their gas/air manifolds arranged in a line along and sharing said common wall with said air plenum to thereby provide said control means for said gas burners in a line adjacent the top surface of the cooktop.

8. The dual mode downdraft gas range of claim 2 wherein said combustion air blower has less inertia than said downdraft exhaust blower and accelerates faster.

9. A method of dual mode cooking with a gas burner and a downdraft exhaust, comprising:

providing an atmospheric and a powered mode of gas burner operation; and further comprising in the powered mode of gas burner operation;

creating a forced flow of a combustion air at a pressure above atmospheric pressure;

mixing the forced flow of combustion air with a flow of gas;

directing the mixture of the forced flow of combustion air and gas to the gas burner through a sealed conduit;

controlling the flows of combustion air and gas to provide a controlled variable combustion of gas at the gas burner;

combusting the directed flow of gas with the combustion air at the gas burner for cooking; and exhausting gaseous combustion and cooking by-products by providing a downdraft adjacent the gas burner, and further comprising in the atmospheric mode of gas burner operation;

directing a flow of gas and an induced flow of air from atmosphere to the gas burner through said sealed conduit;

controlling the flow of gas to the gas burner; and combusting the gas at the gas burner while precluding operation of the downdraft exhaust.

10. The method of claim 9 wherein the gas burner is carried by a sealed top and the downdraft is exhausted into an opening in the sealed top adjacent to the gas burner.

11. The method of claim 9 wherein in the powered mode of operation the forced flow of combustion air and gas is divided by the gas burner into a plurality of flows for combustion and said flows of gas and air are given flow rates and velocities providing rapid, substantially complete combustion and short, stable cooking flames in the plurality of flows providing even heat distribution in the presence of the downdraft exhaust.

12. A dual mode downdraft gas range, comprising:

a cooktop comprising a top surface adapted to be sealed to a plurality of gas burner assemblies;

a downdraft plenum having an inlet adjacent the plurality of gas burner assemblies adapted to withdraw combustion byproducts and cooking vapors from adjacent the top surface and said plurality of burners, a downdraft exhaust blower having its inlet connected with said downdraft plenum;

an air plenum adjacent the top surface of the cooktop;

a combustion air blower with its outlet connected with the air plenum and its inlet open to atmosphere, said air blower being adapted to pressurize said air plenum above atmospheric pressure with a flow of air when operated and to permit a flow of air from atmosphere to said air plenum when not in operation;

a plurality of combined air and gas flow supply means, one for each of said plurality of gas burner assemblies;

each of said plurality of combined air and gas flow supply means comprising:

means forming a separate gas/air mixing chamber having a common wall with said air plenum, and said common wall having an air flow opening communicating with each separate gas/air mixing chamber whereby air may flow from said air plenum into each said gas/air mixing chamber;

means to control both the flow of gas and the flow of air into the gas/air mixing chamber;

means within the gas/air mixing chamber for combining a flow of gas with a flow of air; and a plurality of sealed conduits, each sealed conduit leading from one of said gas/air mixing chambers to one of said plurality of gas burner assemblies.

13. The dual mode downdraft gas range of claim 12 wherein said plurality of combined air and gas flow supply means are located in a line along said air plenum.

14. The dual mode downdraft gas range of claim 12 wherein said air flow from said air plenum into each of said gas/air mixing chambers is controlled by a rotatable actuator for an air flow control cam adjacent the air flow opening in said common wall.

15. The dual mode downdraft gas range of claim 12 further comprising a control to operate said combustion air blower whenever said downdraft exhaust blower is operated.

16. The dual mode downdraft gas range of claim 12 wherein said combustion air blower has less inertia than said downdraft exhaust blower.

17. The dual mode downdraft gas range of claim 12 wherein said gas flow into each of said gas/air mixing chambers is controlled by a gas valve operated by a rotatable actuator, and gas flow varies substantially linearly with rotation of the actuator, and a rotatable flow control cam is carried by the rotatable actuator of an associated gas valve and has an eccentrically shaped peripheral edge to cooperate with an associated air flow opening in the common wall between the air plenum and its gas/air mixing chamber to provide air flow into the gas/air mixing chamber that varies proportionally to the gas flow from its associated gas valve.

* * * * *